US005471182A

United States Patent [19]

Rivera et al.

[11] Patent Number: 5,471,182

[45] Date of Patent: Nov. 28, 1995

[54] BROADBAND PRESSURE BARRIER FOR CIRCULAR WAVEGUIDE

[75] Inventors: David F. Rivera, Westerly, R.I.; Thomas R. Floyd, Waterford; Michael J. Josypenko, Norwich, both of Conn.

[73] Assignee: The United States of America as represented by the Secretary of the Navy, Washington, D.C.

[21] Appl. No.: 287,023

[22] Filed: Aug. 8, 1994

[51] Int. Cl.[6] ..... H01P 1/08

[52] U.S. Cl. ..... 333/252; 333/34

[58] Field of Search ..... 333/33, 34, 230, 333/252

[56] References Cited

U.S. PATENT DOCUMENTS

| | | | |
|---|---|---|---|
| 3,001,160 | 9/1961 | Trousdale | 333/252 |
| 3,594,667 | 7/1971 | Mann | 333/252 X |
| 4,556,854 | 12/1985 | Hiramatsu | 333/252 X |

FOREIGN PATENT DOCUMENTS

| | | | |
|---|---|---|---|
| 1280657 | 12/1986 | U.S.S.R. | 333/252 |

*Primary Examiner*—Paul Gensler

*Attorney, Agent, or Firm*—Michael J. McGowan; Prithvi C. Lall; Michael F. Oglo

[57] ABSTRACT

A broad passband pressure barrier arrangement is provided for insertion in a circular waveguide between a source and a receiver of radio frequency (RF) energy with a spatially circumferential electric field characteristic of the $TE_{01}$ mode. At least three abutting cylindrical barrier regions are coaxially aligned a arranged symmetrically in mirror image fashion about a radial plane of the circular waveguide. The cylindrical barrier regions include: at least one solid cylindrical plug region sealed in a cross-section of the circular waveguide and having a longitudinal thickness sufficient to withstand a predetermined pressure load, and at least one solid cylindrical tuning region having a radius less than that of the circular waveguide and further having a longitudinal thickness. Each of the cylindrical barrier regions are defined by a characteristic impedance at opposing end faces thereof and a by characteristic impedance between the opposing end faces. A region-by-region impedance analysis process begins with an end face of the arrangement that is furthest from the source and is completed with an end face of the arrangement that is nearest the source. The radius of the tuning region(s) and the longitudinal thicknesses of the plug and tuning regions are optimized across the passband of interest.

12 Claims, 2 Drawing Sheets

BROADBAND PRESSURE BARRIER FOR CIRCULAR WAVEGUIDE

STATEMENT OF GOVERNMENT INTEREST

The invention described herein may be manufactured and used by or for the Government of the United States of America for Governmental purposes without the payment of any royalties thereon or therefor.

CROSS-REFERENCE TO RELATED PATENT APPLICATION

This patent application is co-pending with related patent application Ser. No. 08/287,026 entitled Improved Broadband Waveguide Pressure Window (Navy Case No. 73157) by the same inventors as this application.

BACKGROUND OF THE INVENTION (1) Field of the Invention

The present invention relates generally to pressure barriers for circular waveguides, and more particularly to a broadband pressure barrier for circular waveguides capable of electromagnetically passing a broad passband of radio frequency energy while also serving as a mechanical sealing barrier.

(2) Description of the Prior Art

In underwater waveguides, pressure barriers must mechanically block the passage of water when flooded while allowing electromagnetic energy to pass therethrough with minimal reflection when in the dry state. The dimensions of the barrier (i.e., its thickness) and the type of material used determines the mechanical, or hydrostatic pressure blocking ability. There are a number of materials that can be used for this purpose. In most cases, however, electrical characteristics and mechanical characteristics are not compatible. For example, if a single disk barrier were placed in a circular waveguide, it would have a nominal thickness of a half-wavelength at the center of the passband of interest. If the disk has a large relative permittivity (greater than 5), the disk may be capable of passing electromagnetic energy, but the thickness of the disk may not be sufficient to withstand the expected pressure. On the other hand, a disk fabricated from a material with a low relative permittivity (less than 3) will be thicker and better able to withstand the expected pressures, but the electrical characteristics may be unsuitable for the passage of electromagnetic energy.

In the past, pressure barriers for circular waveguide applications comprised a series of cascaded disks as shown in the axial cross-section in FIG. 1. As given in FIG. 1, pressure barrier 10 is sealed in a cylindrical waveguide 100 and consists of three cascaded disks 11, 12 and 13. Low permittivity disks 11 and 13 allow for impedance matching between the empty waveguide and high permittivity disk 12 such that barrier 10 minimizes the reflection from an impinging electromagnetic field. Disks 11 and 13 are nominally a quarter-wave thick (measured with respect to wavelength in waveguide 100) at the center of the passband of operation. This arrangement can meet the requirement of low reflection and resistance to collapse under high hydrostatic pressure if the center or high-permittivity disk 12 is mechanically capable of doing so. The difficulty in this arrangement is that low permittivity disks 11 and 13 must be manually tuned so that reflection is minimized. This is performed by manually grinding or lapping the disks, and assembling the barrier to check the voltage standing wave ratio (VSWR), from which the reflection coefficient is computed. If the VSWR is not within specified limits, the barrier is disassembled, and the tuning process is repeated—a time consuming and expensive procedure.

Another pressure barrier design offering low reflection to an incident propagating field is shown in the axial cross-section of FIG. 2 where two pressure barrier disks 20 and 21 are inserted in circular waveguide 100. However, to be effective, tolerances between disks 20 and 21 must be kept on the order of 0.0002 to 0.0005 inches. This makes the barrier manufacturing process difficult and expensive. If a small VSWR is required, more disks are cascaded in a similar spaced apart fashion. The disks can differ in permittivity and can be spaced to yield a minimum VSWR across the band of interest. Although effective in reducing the VSWR, spacing tolerances increase the level of complexity. Another problem associated with the multiple disk system is that the relative permittivities of the disks can vary thereby adding a design parameter to be considered.

It is further known in the prior art to thin or thicken a dielectric disk along longitudinal regions thereof where the electric field is at its maximum intensity. For example, in U.S. Pat. No. 3,594,667, the dielectric disk is altered in a fashion that improves the high-power operating bandwidth of the disk. The objectives of the alterations are met by tuning out extraneous electromagnetic waveguide modes (i.e. "ghost modes") that are evanescent in the dielectric region. (The ghost mode fields have a detrimental effect on the high-power handling ability of the disk.) The extent of the alterations is arrived from a knowledge of the electric field configuration possessed by the ghost modes.

In U.S. Pat. No. 4,556,854, a microwave window assembly is disclosed for joining rectangular waveguides. The assembly includes a metal support structure having an opening that is smaller than the inside cross-sectional opening of either of the rectangular waveguides. A circular dielectric window, approximately one half-wavelength thick at a center frequency of the passband of the rectangular waveguides, is mounted in the support structure. A pair of matching circular stubs extend outward from opposing surfaces of the window. Each stub is a quarter-wavelength thick at the same frequency as the frequency for determining the thickness of the window. The support structure, window and matching stubs function as a unit. Dimensions for the support structure, window and matching stubs are based on the dimensional relationships between the rectangular waveguides to be joined. However, insertion of such a design into a circular waveguide designed to handle spatially circumferential electric fields (e.g., the $TE_{01}$ mode) would subject the electric field to conversion losses as the impinging electric field crashed into such a disruptive assembly.

SUMMARY OF THE INVENTION

Accordingly, it is an object of the present invention to provide a pressure barrier arrangement, and method for designing same, to pass a broadband radio frequency (RF) signal through a circular waveguide while simultaneously serving as a mechanical obstruction to the passing of a pressurized fluid such as water should water enter the waveguide.

Another object of the present invention is to provide a pressure barrier arrangement to pass a broadband RF signal with a spatially circumferential electric field characteristic of the $TE_{01}$ mode through a circular waveguide without conversion losses.

Still another object of the present invention is to provide a pressure barrier arrangement that may be properly sized according to a systematic method for a particular application in order to avoid trial and error sizing of the barrier arrangement.

Other objects and advantages of the present invention will become more obvious hereinafter in the specification and drawings.

In accordance with the present invention, a broad passband pressure barrier arrangement is provided for insertion in a circular waveguide between a source and a receiver of radio frequency (RF) energy with a spatially circumferential electric field. At least three abutting cylindrical barrier regions, formed of a dielectric material, are coaxially aligned and arranged symmetrically in mirror image fashion about a radial plane of the circular waveguide. The cylindrical barrier regions include at least one solid cylindrical plug region sealed in a cross-section of the circular waveguide. The plug region must be longitudinally thick enough to withstand a predetermined pressure load. The cylindrical barrier regions also include at least one solid cylindrical tuning region having a radius less than that of the circular waveguide and further having a longitudinal thickness. Each of the cylindrical barrier regions are defined by a characteristic impedance at opposing end faces thereof and a by characteristic impedance between the opposing end faces. A region-by-region impedance analysis process begins with an end face of the arrangement that is furthest from the source and is completed with an end face of the arrangement that is nearest the source. The radius of the tuning region(s) and the longitudinal thickness of the plug and tuning regions are optimized across the passband. Optimization is achieved when the input impedance of the barrier as a whole as seen from the source side is equal to the characteristic impedance of the circular waveguide.

BRIEF DESCRIPTION OF THE DRAWINGS

Other objects, features and advantages of the present invention will become apparent upon reference to the following description of the preferred embodiments and to the drawings, wherein.

DESCRIPTION OF THE PREFERRED EMBODIMENTS

Figure 1:
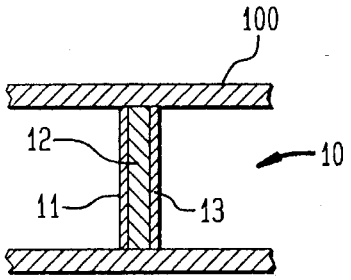
FIG. 1 (PRIOR ART)
FIG. 1 is an axial cross-section of a prior art cascaded disk pressure barrier arrangement for a circular waveguide.
Figure 2:
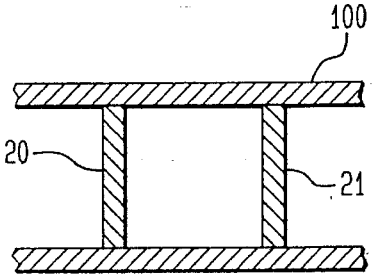
FIG. 2 (PRIOR ART)
FIG. 2 is an axial cross-section of a prior art spaced-apart disk pressure barrier arrangement for a circular waveguide.
Figure 3:
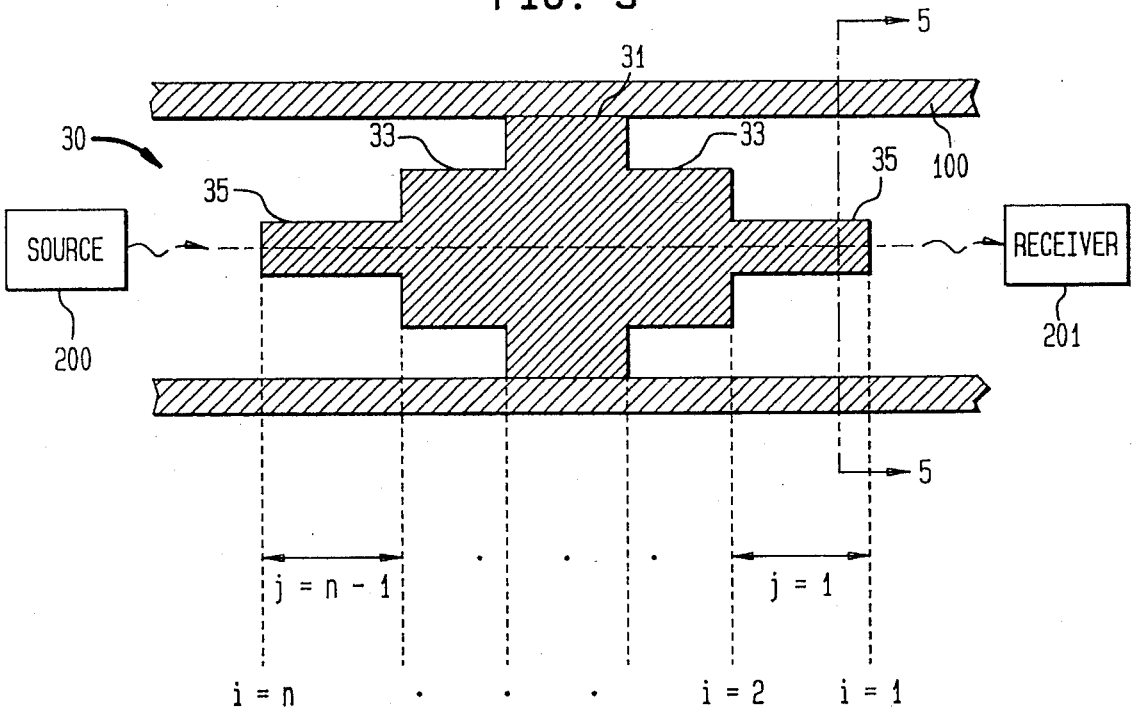
FIG. 3 is an axial cross-section of a preferred embodiment pressure barrier according to the present invention.

Referring now to the drawings, and more particularly to FIG. 3, an axial cross-section of a preferred embodiment pressure barrier 30 is shown installed in a circular waveguide 100. As shown, pressure barrier 30 consists of a solid, cylindrical dielectric plug region 31 and two pair of solid, cylindrical dielectric tuning regions 33 and 35 extending from plug region 31. Alternatively, depending on the bandwidth of interest, only one pair (smaller bandwidths) or three or more pair (larger bandwidths) of tuning regions may be provided. Plug region 31 and tuning region pairs 33 and 35 are fabricated from the same material and may be constructed as a single unit as shown for mechanical strength and ease of construction. Plug region 31 is sealed in place against the inside walls of waveguide 100. Typically, soldering or brazing processes well known in the art are employed such that the only obstruction seen by an electric field propagating from source 200 (e.g., transmitter) to receiver 201 (e.g., antenna) is pressure barrier 30.

Plug region 31 and tuning region pairs 33 and 35 are coaxially aligned and arranged symmetrically about plug region 31 in telescopic fashion in order of decreasing radius. The tuning regions effective relative permittivities change with frequency even though the bulk relative permittivities are the same as plug region 31. In this way, the electrical performance of pressure barrier 30 is equivalent to a multitude of disks with many different permittivities. Since pressure barrier 30 passes a range of frequencies with little reflection, its operation is similar to a bandpass filter with many stages. Experiments have shown that the telescopic disk design also increases the maximum pressure handling ability over that of a flat disk. Specifically, stress is distributed over barrier 30 and is diminished at the barrier-waveguide interface.

Figure 4:
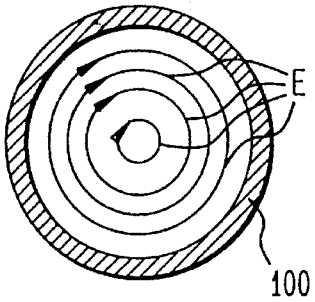
FIG. 4 is a head-on view of a circular waveguide showing the electric field pattern associated with a propagating mode such as the $TE_{01}$ mode.

Pressure barrier 30 is designed to minimize reflection of an electric field propagating through circular waveguide 100 in a spatially circumferential pattern as displayed, for example, by the $TE_{01}$ mode. FIG. 4 shows a head-on view of circular waveguide 100 where E represents the spatially circumferential electric field pattern illustrative of the $TE_{01}$ mode.

In some present applications (frequency range: 43.5 GHz–45.5 GHz), circular waveguide 100 connects a source 200 to a receiver 201 and operates in the $TE_{01}$ mode. Accordingly, the design of pressure barrier 30 will be discussed as it relates to this mode. However, the pressure barrier design and technique for sizing same presented herein can be extended to any mode and waveguide cross-section, so long as the mathematical expressions describing the wave propagation in the waveguide are known.

Pressure barrier 30 is designed in a manner such that its dimensions (e.g., thickness of each region and diameters of each tuning region pair) yield the lowest possible VSWR over the passband of interest. Optimum dimensions of pressure barrier 30 are computed using a minimization technique such as the method of steepest descent. However, it is to be understood that other optimization methods may be utilized.

The required operating bandwidth of pressure barrier 30 is provided for by matching the wave impedance of waveguide 100 preceding and following pressure barrier 30. Each tuning region behaves as a frequency dependent tuner by altering the electromagnetic wave's velocity in each of the tuning regions. The $TE_{01}$ mode is not a dominant mode and is susceptible to mode conversion. Accordingly, design of the pressure barrier in the present invention uses the propagation constant $\beta$ to properly gauge the wave's behavior as it passes through pressure barrier 30. Further, use of cylindrical tuning regions makes the sizing problem easier to solve since they are parallel to a spatially circumferential electric field (see FIG. 4) and therefore generate a minimum of field distortion.

Optimal sizing of the thickness of plug region 31, and the radius and thickness of tuning region pairs 33 and 35, is accomplished in accordance with a region-by-region impedance analysis process using the propagation constant $\beta$. This process starts with the region nearest receiver 201 and finishes with the region nearest source 200. The sizing process is carried out region-by-region for the whole of barrier 30. Then, when the input impedance viewed from the end boundary (i=n) facing source 200 is equal to the characteristic impedance of waveguide 100 over a substantial portion of the RF passband, the reflection back to source 200 is minimized. This condition is representative of a VSWR close to unity over the passband. The process is repeated over a variety of frequencies in the passband of interest.

To perform the impedance analysis process, pressure barrier 30 is viewed in terms of n boundaries and (n−1) regions as shown in FIG. 3. The process begins with the knowledge that the characteristic impedance $Z_c$ in the waveguide region between pressure barrier 30 and receiver 201 is equal to the characteristic impedance of the transmission medium (e.g., air) or $Z_{c(air)}$. Using this fact, the characteristic impedance for each i-th barrier and j-th region can be successively evaluated in a stepwise process that progresses along barrier 30 from the end nearest receiver 201 to the end nearest source 200.

The input impedance at each i-th boundary or $Z_{in(1)}$ is based on the transmission line formula $$Z_{in(i)} = Z_{c(j)} \frac{Z_{L(i-1)} + Z_{c(j)}\tanh(\gamma_{(j)}t_{(j)})}{Z_{c(j)} + Z_{L(i-1)}\tanh(\gamma_{(j)}t_{(j)})} \tag{1}$$

where $Z_c(j)=k_0Z_0/\beta_j$, $k_0$ being the wave number $2\pi f/v$ (f being the frequency and v being equal to the speed of light) in free space, $Z_0$ being the wave impedance of free space ($\cong 376.7\Omega$), and $\beta_j$ being the complex portion of the propagation constant $\gamma$ for the j-th region.

$Z_{L(i-1)}$ is the load impedance viewed by the previous boundary (i.e., next successive boundary in the direction of receiver 201);

$\gamma_{(j)}$ is the complex propagation constant for the j-th region; and $t_{(j)}$ is the thickness of the j-th region. For the complex propagation constant $$\gamma = \alpha^c + \alpha_j^d + \sqrt{-1}\ \beta_j \tag{2}$$

$\alpha^c$ is the attenuation due to finitely conducting metal walls, and $\alpha_j^d$ is the attenuation constant of the j-th disk due to the presence of a dielectric having a high loss tangent. The contribution of $\alpha_j^d$ to $\gamma$ is negligible for the barriers of interest in the present invention. For the $TE_{01}$ mode, $$\alpha^c = \frac{1}{bZ_0}\sqrt{\frac{\omega\mu_0}{2\sigma}}\ \frac{x^2}{\sqrt{1-x^2}} \tag{3}$$

where b is the inside radius of waveguide 100;

$\omega$ is the angular frequency $2\pi f$;

$\mu_0$ is the permeability of free space ($4\pi\times10^{-7}$ Henry/meter (H/m));

$\sigma$ is the conductivity of the material used to construct waveguide 100; and $x=k_c/k_0$, $k_c$ being the cutoff number of waveguide 100 that is equal to $P'_{01}/b$, $P'_{01}$ being a constant (3.83171) for the $TE_{01}$ mode.

Figure 5:
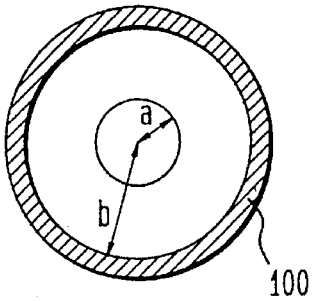
FIG. 5 is a radial cross-section of the waveguide and pressure barrier taken along line 5—5 of FIG. 3.

$\beta_j$ is the complex portion of the propagation constant and is computed in the following manner. For each j-th region, a radial cross-section of waveguide 100 includes a dielectric region and an air region (note that there is no air region associated with plug region 31). By way of example, one such radial cross-section has been taken along line 5–5 and is shown in FIG. 5 where a is the radius of tuning region 35, b is the radius of waveguide 100 and the air region lies between tuning region 35 and waveguide 100. $\beta$ is solved for by computing the electric and magnetic fields in each of the dielectric and air regions and matching the fields at the interface between the air and dielectric regions. This process is based on the radial wave number $k_D$ in the dielectric region, the radial wave number $k_A$ in the air region, the well known separation equations as follows:

$$k_D^2 = k_0^2\epsilon_r - \beta^2 \tag{4}$$

$$k_A^2 = k_0^2 - \beta^2 \tag{5}$$

and the well known characteristic equation:

$$\frac{J_1(k_Ab)}{N_1(k_Ab)} = \frac{k_DJ_0(k_Da)J_1(k_Aa) - k_AJ_1(k_Da)J_0(k_Aa)}{k_DJ_0(k_Da)N_1(k_Aa) - k_AJ_1(k_Da)N_0(k_Aa)} \tag{6}$$

where $\epsilon_r$ is the relative permittivity of the dielectric region, $J_0$ and $J_1$ are the Bessel functions for the 0 and 1 orders, respectively, and $N_0$ and $N_1$ are the Neumann functions for the 0 and 1 orders, respectively.

Equation (6) has infinitely many values of $k_A$ that satisfy the equality. Each solution describes the $TE_{0m}$ mode where m is the m-th root. The first root (i.e., the value of $k_A$) corresponds to the $TE_{01}$ mode. To simplify the solving of equation (6), equations (4) and (5) may be simplified. Specifically, $$k_D^2 - k_A^2 = [k_0^2\epsilon_r - \beta^2] - [k_0^2 - \beta^2] = k_0^2(\epsilon_r - 1) \tag{7}$$

or $$k_D = \sqrt{k_A^2 + k_0^2(\epsilon_r - 1)} \tag{8}$$

This simplification makes it possible to solve equation (6) for only one unknown, namely $k_A$.

In order to initiate the analysis or design process, a barrier material and thickness must be selected based on the mechanical pressure load requirements. The passband of interest, type of transmission line, type of source and the desired VSWR will ultimately determine the number of total regions that must be used/optimally sized by the present invention. Further, each of the regions must be assigned initial value "guesses" in terms of radius and thickness. Finally, the center frequency of the passband of interest is generally selected as the first frequency to be optimized.

Once $\gamma_{(j)}$ is determined for the region nearest receiver 201, equation (1) for $Z_{(i)}$ can be solved. Note that the first time through, $Z_{L(i=1)}$ is equal to $Z_{c(air)}$. For each frequency, the radius and/or thickness of each region are optimized throughout the stepwise process (e.g., by the method of steepest descent) so that at the boundary i=n, $Z_{in(i)} \approx Z_{c(air)}$. This is the optimal condition that yields a VSWR of 1 since $$VSWR = \frac{1 + |\rho_n|}{1 - |\rho_n|} \quad (9)$$

where $|\rho_n|$ is the magnitude of the reflection coefficient. The complex reflection coefficient $\rho_n$ is computed from $$\rho_n = \frac{Z_{in(n)} - Z_{c(air)}}{Z_{in(n)} + Z_{c(air)}} \quad (10)$$

where $Z_{in(n)}$ is the n-th boundary input impedance, and $Z_{c(air)}$ is the characteristic impedance of the empty guide.

The pressure barrier designed and optimized in the above described fashion behaves as a tuned circuit. It will offer a high degree of reflection outside the radio frequency band of interest, and allow the traversal of electromagnetic energy with minimal (or negligible) reflection in the passband. It is also a mechanical obstruction. If made from a mechanically strong material, it blocks water thereby protecting a transmitting source from sea water damage. The strength of the material determines the ultimate hydrostatic pressure for a given operational (tactical) specification.

Each tuning region matches the characteristic impedance of the air-filled portion of the waveguide to the completely filled (dielectric) portion. Each tuning region acts as a transmission line which, through its length, changes or transforms the impedance at the point where the neighboring tuning region begins. The characteristic impedance, which is highly frequency-dependent in the present case, is controlled by the diameter of the tuning region. The end result is a tuning region that is frequency-dependent, allowing greater flexibility in impedance matching. When cascaded with other tuning regions, it is possible to have an impedance match over a broad range of frequencies.

The advantages of the present invention are numerous. The pressure barrier is a one-piece construction that offers a high mechanical strength over a broad range of frequencies. Once the design parameters are optimized for a particular application, the pressure barrier is easily constructed by molding or turning on a lathe. In low-power applications (i.e., less than or equal to 30 watts), the pressure barrier may be made from a low power plastic such as compounds of polyphenylene oxide and polystyrene (e.g., Noryl), polyethylene, polystyrene, acrylic (e.g., plexiglas), polycarbonate resin (e.g., Lexan), cross-linked polystyrene (e.g., Rexolite) or any other plastic that has a low loss tangent. For medium and high-power applications (i.e., greater than 30 watts), the pressure barrier may be made from a glass (e.g., fused silica or quartz) or ceramic (e.g., beryllium oxide or aluminum nitride) that has a high mechanical strength and a low loss tangent.

Figure 6:
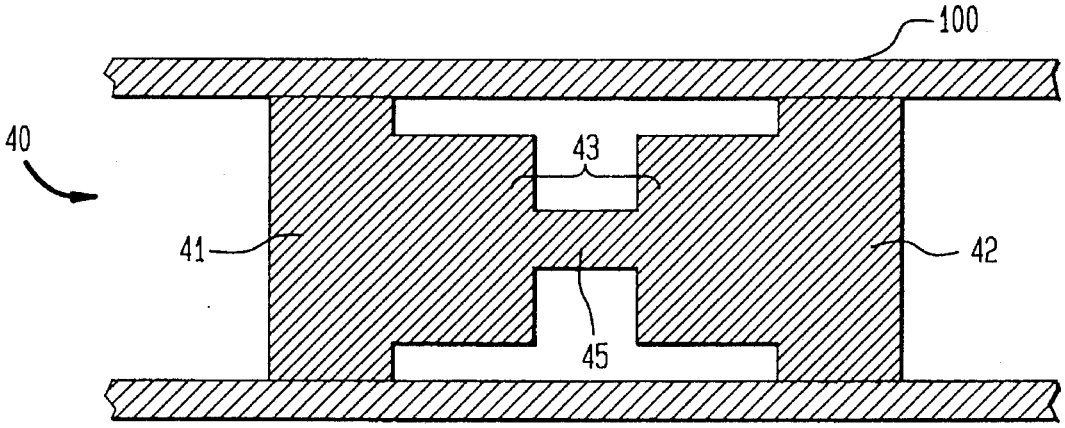
FIG. 6 is an alternative embodiment pressure barrier according to the present invention.

While the present invention has been described relative to a particular embodiment, its teachings are not so limited. For example, the number of tuning regions can be increased or decreased depending on bandwidth requirements. In addition, although the preferred embodiment has one plug region and tuning region pairs that extend therefrom telescopically in mirror image fashion in order of decreasing radius, this need not be the case. One alternative embodiment pressure barrier 40 is shown in FIG. 6 where two plug regions 41 and 42 form the ends of the barrier. Plug regions 41 and 42 are connected by tuning region pair 43 (or pairs if the bandwidth so requires) and one central connecting tuning region 45 that forms the center region of pressure barrier 40. All regions are aligned coaxially in waveguide 100 and may be constructed as a single unit. Additional cascading regions may be added to pressure barrier 40 as long as a mirror image symmetry is maintained about the central connecting region 45.

Figure 7:
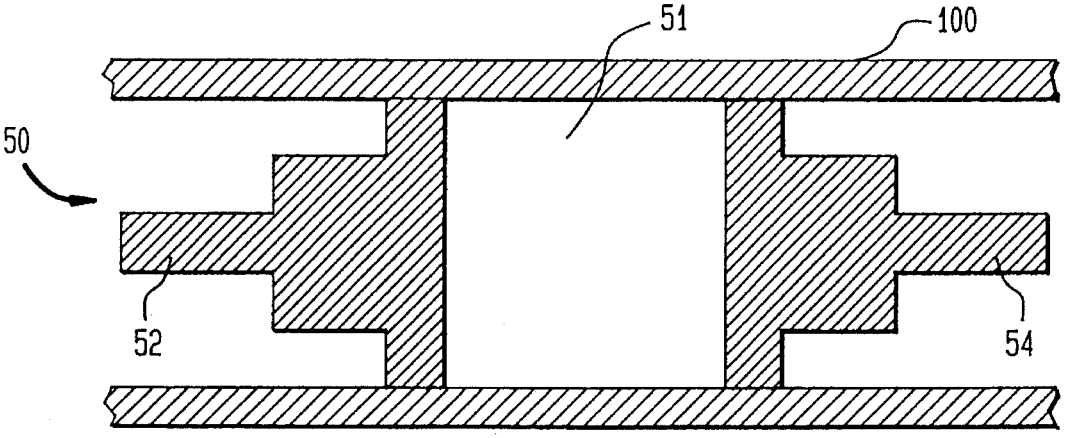
FIG. 7 is another alternative embodiment pressure barrier according to the present invention.

Yet another alternative arrangement is shown in FIG. 7 where pressure barrier 50 includes an air gap 51 separating identically sized telescoping regions 52 and 54. Air gap 51 would be optimized along with regions 52 and 54 to achieve the lowest VSWR. Such a design is advantageous where waveguide 100 is separable at the location of air gap 51 to allow replacement of either region 52 or 54 in case of failure. Note that regions 52 and 54 may telescope outward (as shown) or inward toward air gap 51 (not shown). An air gap could also be employed at a radial plane of symmetry between two or more barriers of the type shown in FIGS. 3 and 6 above. Regardless of the number of regions and arrangement thereof, the impedance analysis design and optimization process described above will be applicable.

It will thus be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A broad passband waveguide/pressure barrier arrangement comprising:

a fixed radius circular waveguide for transmitting radio frequency (RF) energy in a spatially circumferential field mode between a source and a receiver;

at least three cylindrical barrier regions formed of a dielectric material, said at least three barrier regions coaxially aligned and arranged symmetrically in mirror image fashion about a radial plane of said circular waveguide, said at least three cylindrical barrier regions including at least one solid cylindrical plug region sealed in a cross-section of said circular waveguide and having a longitudinal thickness sufficient to withstand a predetermined pressure load, and at least one solid cylindrical tuning region having a radius less than that of said circular waveguide and further having a longitudinal thickness; and said radius of said at least one tuning region and said longitudinal thicknesses of said at least three cylindrical barrier regions sized so that an input impedance of said at least three cylindrical barrier regions as seen by the source is equal to a characteristic impedance of said circular waveguide for a passband of interest.

2. An arrangement as in claim 1 wherein said at least one plug region comprises a single plug region centered on said radial plane, and wherein said at least one tuning region comprises an identically sized pair of tuning regions, one of said pair extending from one opposing end face of said single plug region and the other of said pair extending from another opposing end face of said single plug region.

3. An arrangement as in claim 1 wherein said at least one plug region comprises a single plug region centered on said radial plane, and wherein said at least one tuning region comprises a plurality of identically sized pairs of tuning regions, each of said pairs being defined by a unique radius and longitudinal thickness, said pairs being arranged in said mirror image fashion about said radial plane in order of decreasing radius.

4. An arrangement as in claim 1 wherein said at least three cylindrical barrier regions abut one another.

5. An arrangement as in claim 1 wherein said at least three cylindrical barrier regions are fabricated as an integral unit.

6. An arrangement as in claim 1 wherein said dielectric material is selected from the group consisting generally of plastics, glass and ceramics.

7. An arrangement as in claim 1 wherein said at least one tuning region comprises a single tuning region centered on said radial plane, and wherein said at least one plug region comprises two identically sized plug regions, a first of said plug regions extending from one opposing end face of said single tuning region and a second of said plug regions extending from another opposing end face of said single tuning region.

8. An arrangement as in claim 1 wherein said at least one tuning region comprises a first tuning region centered on said radial plane and at least one identically sized pair of tuning regions, each of said at least one identically sized pair being defined by a unique radius larger than that of said first tuning region, said at least one identically sized pair being arranged in said mirror image fashion about said radial plane in order of increasing radius and ending in termination end faces nearest to and furthest from the source, and wherein said at least one plug region comprises two identically sized plug regions, a first of said two identically sized plug regions extending from said terminating end face nearest the source and a second of said two identically sized plug regions extending from said terminating end face furthest from the source.

9. An arrangement as in claim 1 wherein said radial plane passes through free space in said circular waveguide.

10. A broad passband waveguide/pressure barrier arrangement comprising:

a fixed radius circular waveguide for transmitting radio frequency (RF) energy in a spatially circumferential field mode between a source and a receiver;

a solid cylindrical plug region formed of a dielectric material and sealed in a cross-section of said circular waveguide and having a longitudinal thickness for blocking the passage of a predetermined pressure load, said plug region centered on a radial plane of said circular waveguide;

a plurality of solid cylindrical tuning regions formed of said dielectric material, said plurality of solid cylindrical tuning regions consisting of pairs of identically sized tuning regions, each pair having a unique radius and a longitudinal thickness, each pair being arranged symmetrically in mirror image fashion about said radial plane in order of decreasing radius, said plurality of solid cylindrical tuning regions coaxially aligned with said plug region in a contiguous abutting relationship; and each said radius and said longitudinal thickness of said plurality of solid cylindrical tuning regions, and said longitudinal thickness of said solid cylindrical plug region, sized so that an input impedance of a combination of said solid cylindrical plug region and said plurality of solid cylindrical tuning regions as seen from the source is equal to a characteristic impedance of said circular waveguide for a passband of interest.

11. An arrangement as in claim 10 wherein said plug region and said pairs of identically sized tuning regions are fabricated as an integral unit.

12. An arrangement as in claim 10 wherein said dielectric material is selected from the group consisting generally of plastics, glass and ceramics.

* * * * *